US005353987A

United States Patent [19]

Kusakabe et al.

[11] Patent Number: 5,353,987

[45] Date of Patent: Oct. 11, 1994

[54] RAILROAD TRACK SYSTEM HAVING VERTICALLY ADJUSTABLE RAILROAD TIE AND METHOD OF CONSTRUCTION THEREFOR

[75] Inventors: Yoshio Kusakabe, Ibaraki; Toshiaki Doi, Chigasaki, both of Japan

[73] Assignees: Fudo Construction Co., Ltd., Osaka; Central Japan Railway Company, Aichi, both of Japan

[21] Appl. No.: 927,966

[22] Filed: Aug. 11, 1992

[51] Int. Cl.[5] ..... E01B 3/28

[52] U.S. Cl. ..... 238/25; 238/84; 238/24; 238/88

[58] Field of Search ..... 238/5, 24, 25, 74, 83-85, 238/88, 55, 98, 102, 103, 119, 300, 26

[56] References Cited

U.S. PATENT DOCUMENTS

| | | | |
|---|---|---|---|
| 1,066,767 | 7/1913 | Tebyrica | 238/6 |
| 1,118,853 | 11/1914 | Goodell, Jr. | 238/5 |
| 3,300,140 | 1/1967 | Moses et al. | 238/25 |
| 4,106,694 | 8/1978 | Salvino | 238/85 X |
| 4,609,144 | 9/1986 | Harmsen | 238/83 X |
| 4,652,495 | 3/1987 | Sato et al. | 238/84 X |

FOREIGN PATENT DOCUMENTS

| | | | |
|---|---|---|---|
| 3429413 | 2/1986 | Fed. Rep. of Germany | 238/84 |
| 2385844 | 12/1978 | France | 238/25 |
| 377872 | 11/1940 | Italy | 238/24 |
| 1461810 | 2/1989 | U.S.S.R. | 238/25 |

*Primary Examiner*—Michael S. Huppert
*Assistant Examiner*—Stephen Gordon
*Attorney, Agent, or Firm*—Wenderoth, Lind & Ponack

[57] ABSTRACT

A railroad track has a roadbed made of concrete and a pair of track beams of precast concrete mounted to the roadbed. Main bodies of the track beams have at the tops thereof a plurality of protrusions serving as ties and a plurality of recesses for receiving adjusting ties. The protrusions and the recesses are alternately disposed in the longitudinal direction of the beams. The track beams extend continuously in parallel, and a pair of rails are laid on the track beams. A method of constructing the track includes the steps of supporting the track beams on the roadbed with screwjacks embedded in the main bodies of the track beams, and forcing concrete between the main bodies of the track beams and the roadbed to form concrete layers securing the track beams to the roadbed.

2 Claims, 2 Drawing Sheets

RAILROAD TRACK SYSTEM HAVING VERTICALLY ADJUSTABLE RAILROAD TIE AND METHOD OF CONSTRUCTION THEREFOR

BACKGROUND OF THE INVENTION

The present invention relates to a track for a railroad or the like and a method of constructing the same.

The ballast track using track bed ballast has a problem that the track bed ballast is destroyed easily and the repairing of destroyed ballast requires much labor.

A slab track which uses a slab made by precasting concrete instead of track bed ballast is more durable and requires little repairing. But the slab is wide, bulky and heavy and thus is difficult to manufacture, transport and install. Moreover, if tile roadbed supporting the slab sinks so remarkably that there arises a necessity to readjust the height (level) of the rail surfaces, a cement-asphalt-mortar layer between the slab and the roadbed has to be replaced. Such work is very time-consuming and troublesome.

SUMMARY OF THE INVENTION

A first object of the present invention is to provide a track which is more durable and which is free of the above-mentioned problems.

A second object is to provide a method of constructing the same.

A track according to the present invention comprises a roadbed made of concrete, a pair of track beams made by precasting concrete and having at their top a plurality of protrusions serving as ties and a plurality of recesses for receiving adjusting ties, the protrusions and the recesses being arranged so as to alternate with each other in the longitudinal direction of the beams, the track beams being arranged on the roadbed so as to extend continuously in the longitudinal direction and secured to the roadbed, and a pair of rails laid on the track beams.

Since this track uses no track bed ballast, it is durable like the above-mentioned slab track. Furthermore, after setting it up, if the roadbed should sink so considerably as to require a considerable readjustment of the height of the rail surfaces, such a readjustment can be made fairly easily by inserting adjusting ties of a predetermined size in the recesses of the track beams. Further, since the track beams used in this invention are narrow, small and lightweight compared with the slabs of a slab track, they can be manufactured, transported and installed very easily.

The first track constructing method of the present invention is used when constructing a new track. This method comprises the steps of placing track beams made by precasting concrete on a roadbed made of concrete at predetermined positions, the track beams including main bodies provided at their tops with a plurality of protrusions spaced at predetermined intervals in the longitudinal direction, and having a pair of screw jacks embedded in the protrusions at each end of the main body thereof, while the track beams are supported on the roadbed by means of the screw jacks, adjusting the vertical position of the track beams by adjusting the screw jacks, forcing concrete between the main bodies of the track beams and the roadbed to secure the track beams to the roadbed through the concrete layers thus formed, and laying rails on the track beams. With this method, even if the accuracy in the level of the top surface of the preformed roadbed is not very good, the top surfaces of the rails can be easily adjusted to a predetermined level by adjusting the vertical position of the track beams with the screw jacks embedded beforehand. Thus a new track can be constructed efficiently.

In placing the track beams on the roadbed at predetermined positions, the track beams may be coupled together at the construction site to keep them apart by a predetermined distance from each other. This facilitates positioning.

In order to strengthen the track, after the supporting concrete layer has hardened, the concrete layer may be pressed against the sides of the track beams by PC steel members extending laterally through the track beams and the supporting concrete layer which prestress the track beams.

A vibration-proof material such as rubber may be attached beforehand to the outer surfaces of the track beams to be brought into contact with the support concrete layers. In this case, the track beams are preferably coupled together with coupling members.

The second method of the present invention is used when replacing an existing track with the track according to this invention. This method comprises the steps of placing track beams made by precasting concrete on a roadbed made of concrete at predetermined positions, the track beams having main bodies provided at their tops with a plurality of protrusions spaced at predetermined intervals in the longitudinal direction of the beams, pairs of screw jacks embedded in the protrusions not only at ends of the beams but also in the other protrusions, and inserts embedded at one side thereof for receiving steel members, adjusting the vertical position of the track beams by adjusting the screw jacks in the protrusions at both ends, supporting the track beams on all of the screw jacks, fixing first steel members to the inserts to couple the pair of track beams together, securing the intermediate portions of the first steel members to the roadbed with second steel members, thereby stabilizing the track beams so that trains can pass thereon, laying rails on the track beams, and forcing concrete between the track beams and the roadbed to secure the track beams to the roadbed through the concrete layers thus formed. With this method, besides the effects attained with the first method, the train service can be started even before the concrete is forced between the beams and the roadbed or before the concrete layers thus driven harden sufficiently to show a predetermined strength. Thus the replacement of the track can be carried out efficiently.

In employing the present invention, the track beams and the support concrete layers should be reinforced in a suitable manner. In order to firmly secure the track beams, concrete layers and roadbed together, anchor bolts may be embedded in the track beams and the roadbed beforehand.

BRIEF DESCRIPTION OF THE DRAWINGS

Other features and objects of the present invention will become apparent from the following description with reference to the accompanying drawings.

DETAILED DESCRIPTION OF THE PREFERRED EMBODIMENTS

Figure 1:
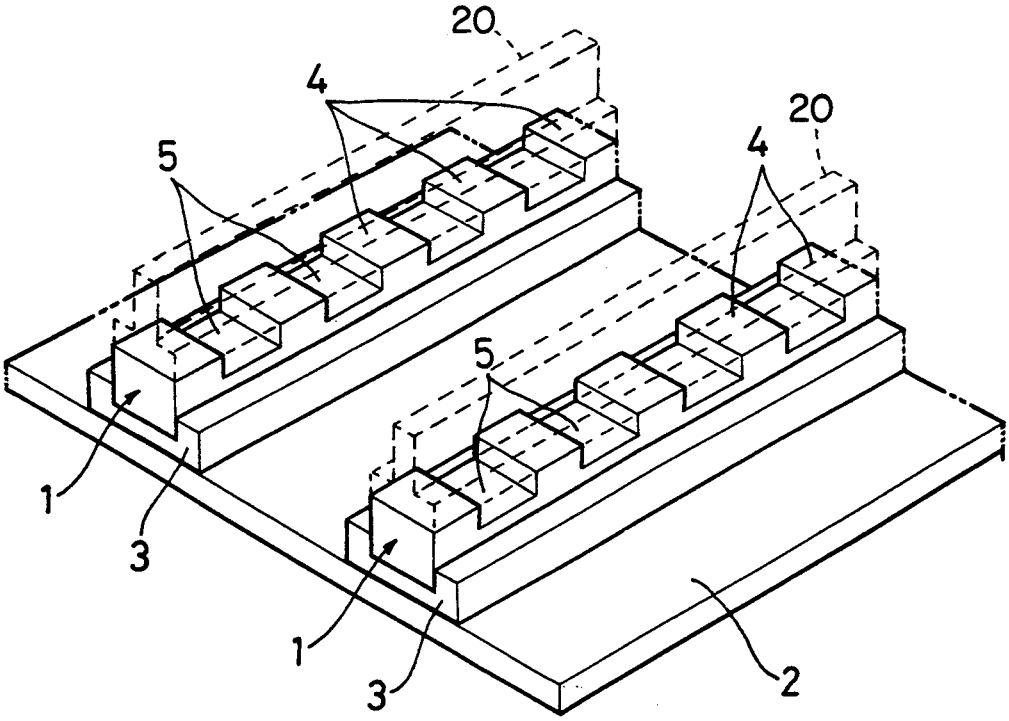
FIG. 1 is a perspective view of a portion of the track.

In FIG. 1, a track beam 1 is made by precasting concrete and a roadbed 2 is made of concrete. The track beams 1 are secured to the roadbed 2 through supporting concrete layers 3.

A pair of track beams 1 are laid to extend continuously in a longitudinal direction of the track at positions where the right and left rails are to be laid.

Each track beam 1 is 5–7 meters long and weighs about 2 tons and is provided on top thereof with a large number of protrusions 4 serving as ties and recesses 5 for receiving adjusting ties, the protrusions 4 and recesses 5 alternating with each other in a longitudinal direction. Though not shown, holes for bolts for securing a rail are formed in the top surface of each protrusion 4. The rails 20 (shown in broken lines in FIGS. 1 and 2) are secured to the track beams 1 with bolts threaded into the bolt holes.

Ordinarily, the rails are laid on the track beams 1 through pads and tie plates. Thus, even if the roadbed should sink so much as to require the correction of the height of the rail surfaces, such correction can be made simply by adjusting the thickness of the pads if the required amount of correction is small.

Figure 2:
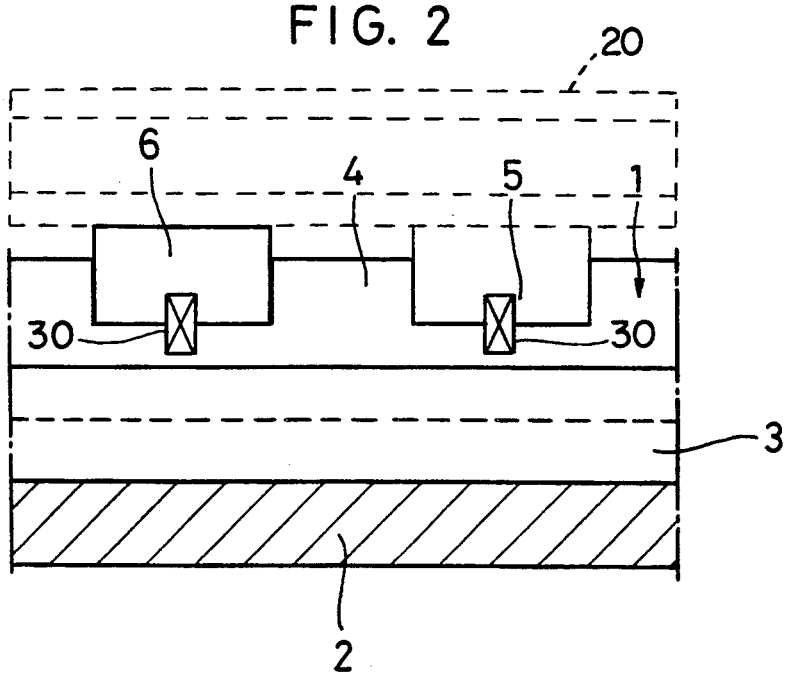
FIG. 2 is a sectional view of the track showing adjusting ties.

If the sinking is so great as not to be correctable with the pads, after removing the rails, adjusting ties 6 of a predetermined size are inserted in the recesses 5 of the track beams 1 and are secured in position as shown in FIG. 2. Then the rails are placed on and secured to the adjusting ties 6. To secure the adjusting ties 6 in position, bolt holes are formed in the surface of the main body of the beam defining the bottom of each recess 5.

The adjusting ties 6 are made of concrete and are of a height equal to the depth of the recesses 5 plus the amount of sinking of the roadbed and of a width substantially equal to the width of the recesses 5. They have bolt holes for securing themselves to the track beams 1 and ones for mounting the rails thereon.

Figure 3:
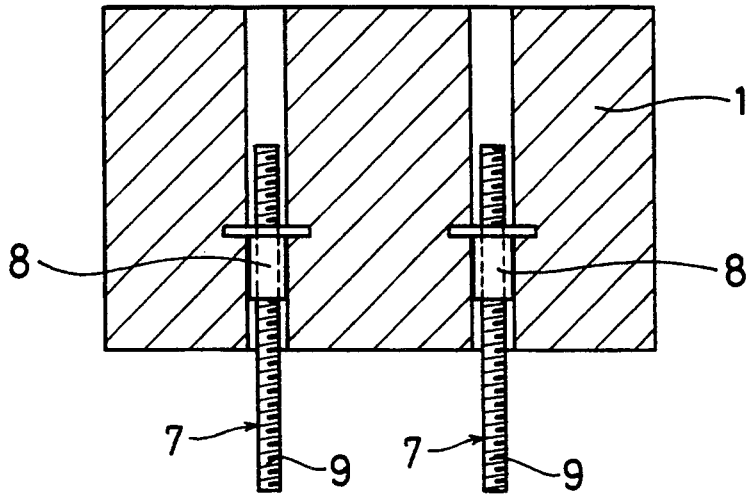
FIG. 3 is a vertical sectional view taken through a protrusion of the track beam showing a pair of screw jacks embedded in the protrusion of the main body of the track beam.

The bolt holes in the main body of the beam 1 and in the adjusting ties 6, as well as the bolted connection, are designated schematically by reference numeral 30 in FIG. 2. As shown in FIG. 3, the track beams 1 have a pair of screw jacks 7 embedded in the protrusion 4 at each end of the track beams 1.

The screw jacks 7 shown in FIG. 3 each comprise a flanged nut 8 and a threaded rod 9 adapted to be movable up and down in the track beam 1 when turned. On the top end of each threaded rod 9 is formed a protrusion (not shown) adapted to engage a turning tool.

The track beams 1 manufactured in the factory and transported to the construction site are supported on a supporting structure in the form of a preformed roadbed (or a floor board of an elevated bridge) through the screw jacks 7.

In this state, the threaded shafts 9 of the screw jacks 7 are rotated to move the track beams 1 up and down so that the tops of the rails to be laid on the track beams 1 will be at a predetermined height. Then concrete is forced between the track beams 1 and the roadbed 2 to firmly secure the track beams 1 to the roadbed 2 through the concrete layers 3 thus formed. Rails are then laid on the track beams 1.

The track beams 1 may be reinforced with iron bars and/or by prestressing. The supporting concrete layers 3 also should be reinforced with suitable means, e.g. by steel fibers mixed into the concrete.

Figure 4:
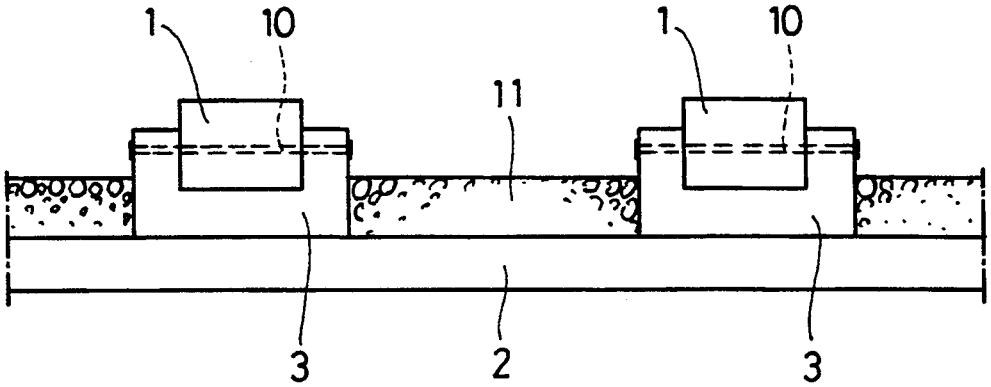
FIG. 4 is a sectional view of rail-supporting structure showing the track beams reinforced by prestressing.

As one means for strengthening the track, as shown in FIG. 4, after the supporting concrete layers 3 have hardened, prestress should preferably be applied by post-tensioning with PC steel members 10 which extend laterally through the track beam 1 and the supporting concrete layer 3 in contact with both sides of the track beam 1, so as to press the supporting concrete layers 5 against both sides of the track beam 1.

In the embodiment of FIG. 4, ballast 11 is spread near the track beams 1 mainly for the purpose of reducing noise when trains pass.

Figure 5:
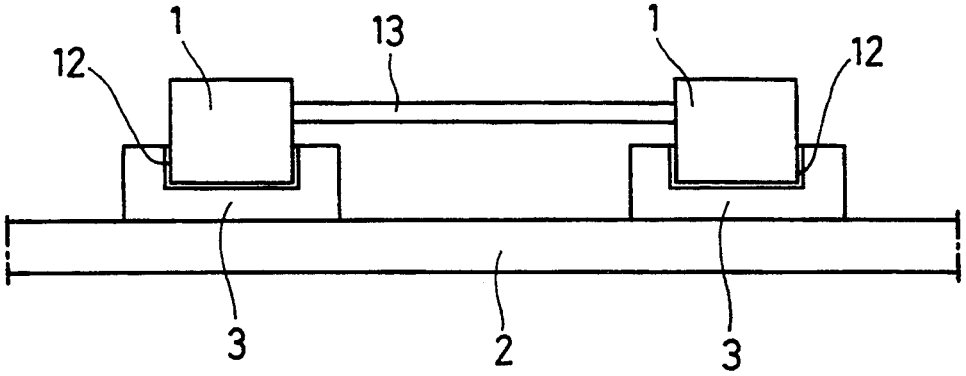
FIG. 5 is a sectional view of the rail-supporting structure of the track having vibration-proof layers disposed between the track beams and the supporting concrete layers.

In order to reduce vibrations, resilient pads may be interposed between the rails and the track beams 1 when laying the rails. Otherwise, a vibration-damping material such as rubber may be attached beforehand to the outer surfaces of the track beams 1 to be brought into contact with the concrete layers 3 to form vibration-proof layers 12 between the track beams 1 and the supporting concrete layers 3 as shown in FIG. 5. In this case, the track beams 1 should be preferably coupled together with coupling members 13 arranged therebetween at predetermined longitudinal intervals.

When replacing an existing track with the track according to the present invention, track beams are used which have pairs of screw jacks embedded not only in the protrusions at both ends of the beams but in the other protrusions, as well. The track beams also have inserts embedded in one side thereof to receive steel members. These track beams are placed on the preformed roadbed while supported through the screw jacks at both ends in the same manner as when constructing a new track. After adjusting the height of the track beams, all the screw jacks are used to support the track beams. Further, steel members are secured to the track beams in the inserts to couple the track beams together at the sides thereof. Then steel members are used to secure the central portions of the first-mentioned steel members to the roadbed to stabilize the track beams to such a degree that the train service can be started. Then the rails are laid on the track beams and the supporting concrete layers are formed between the track beams and the roadbed by forcing concrete between the track beams and the roadbed.

The steel members are provided at predetermined locations along the track beams so as to be spaced apart from each other in the longitudinal direction of the beams. These members may be left unremoved after constructing the track to use them as additional reinforcements of the track.

What is claimed is:

1. Rail-supporting structure of a railroad track system, said structure comprising: a concrete roadbed; a pair of track beams secured to said roadbed and extending longitudinally in parallel, each of said track beams comprising a concrete casting, and each of said track beams having a top portion defining a series of protrusions and recesses, the protrusions and recesses being alternately disposed in the longitudinal direction of each of said track beams, and each of said track beams having bolt holes in first respective surfaces thereof, said first respective surfaces defining bottoms of said recesses; and adjusting ties disposed in the recesses defined in the top portions of said track beams, said adjusting ties having bolt holes therein, said adjusting ties being bolted to said track beams, respectively, via said bolt holes in said first respective surfaces of the track beams and the bolt holes in said adjusting ties, and said adjusting ties protruding above second respective surfaces of said top portions of the track beams, said second respective surfaces defining tops of said protrusions.

2. A railroad track system comprising: a concrete roadbed; a pair of track beams secured to said roadbed and extending longitudinally in parallel, each of said track beams comprising a concrete casting, and each of said track beams having a top portion defining a series of protrusions and recesses, the protrusions and recesses being alternately disposed in the longitudinal direction of each of said track beams, and each of said track beams having bolt holes in first respective surfaces thereof, said first respective surfaces defining bottoms of said recesses; a pair of rails extending along and supported by said pair of track beams; and adjusting ties disposed in the recesses defined in the top portions of said track beams, said adjusting ties having bolt holes therein, said adjusting ties being bolted to said track beams, respectively, via said bolt holes in said first respective surfaces of the track beams and the bolt holes in said adjusting ties, and said adjusting ties protruding above second respective surfaces of said top portions of the track beams, said second respective surfaces defining tops of said protrusions.

* * * * *